US006174140B1

(12) United States Patent
Ota et al.

(10) Patent No.: US 6,174,140 B1
(45) Date of Patent: Jan. 16, 2001

(54) OIL RECOVERY DEVICE FOR COMPRESSORS

(75) Inventors: Masaki Ota; Kenta Nishimura; Hirotaka Kurakake; Hisakazu Kobayashi, all of Kariya (JP)

(73) Assignee: Kabushiki Kaisha Toyoda Jidoshokki Seisakusho, Kariya (JP)

( * ) Notice: Under 35 U.S.C. 154(b), the term of this patent shall be extended for 0 days.

(21) Appl. No.: 09/213,404

(22) Filed: Dec. 17, 1998

(30) Foreign Application Priority Data

Dec. 24, 1997 (JP) ..... 9-355555

(51) Int. Cl.[7] ..... F04B 1/26
(52) U.S. Cl. ..... 417/222.2; 92/154; 184/6.17
(58) Field of Search ..... 417/222.2, 269, 417/313; 92/154; 184/6.11, 104.2

(56) References Cited

U.S. PATENT DOCUMENTS

| | | | | |
|---|---|---|---|---|
| 5,518,374 | | 5/1996 | Ota et al. | 417/222.2 |
| 5,636,974 | * | 6/1997 | Ikeda et al. | 417/269 |
| 5,734,134 | * | 3/1998 | Park | 181/229 |
| 5,823,294 | * | 10/1998 | Mizutani et al. | 184/63 |
| 5,893,706 | * | 4/1999 | Kawaguchi et al. | 417/373 |
| 5,997,257 | | 12/1999 | Ishida et al. | 417/269 |

FOREIGN PATENT DOCUMENTS

| | | |
|---|---|---|
| 196 14 186A | 10/1996 | (DE) . |
| 5-240158 | 9/1993 | (JP) . |
| 7-269485 | 10/1995 | (JP) . |
| 8-35485 | 2/1996 | (JP) . |
| 8-114182 | 5/1996 | (JP) . |

* cited by examiner

*Primary Examiner*—Noah P. Kamen
*Assistant Examiner*—Mahmoud M Gimie
(74) *Attorney, Agent, or Firm*—Morgan & Finnegan, L.L.P.

(57) ABSTRACT

A compressor having a device for recovering lubricating oil. The compressor includes a discharge chamber and a muffler, which attenuates the pressure pulsation of refrigerant gas sent out from the discharge chamber. The muffler is defined by a muffler base, which is formed on the cylinder block, and a muffler cover, which is attached to the muffler base. The muffler includes a first muffler chamber and a second muffler chamber, which are connected by an opening. The muffler cover has a gas outlet for sending the refrigerant gas out of the compressor from the second muffler chamber. Lubricating oil separated from the refrigerant gas in the first muffler chamber is sent to the crank chamber through a recovery passage. The location of the gas outlet can be easily changed by replacing the muffler cover. Thus, the compressor can be easily adapted to different engine compartments.

21 Claims, 4 Drawing Sheets

OIL RECOVERY DEVICE FOR COMPRESSORS

BACKGROUND OF THE INVENTION

The present invention relates to compressors that may be applied to, for example, automotive air-conditioning systems. More particularly, the present invention pertains to mechanisms for separating and recovering lubricating oil from refrigerant gas in compressors.

Japanese Unexamined Patent Publication No. 5-240158 and Japanese Unexamined Patent Publication No. 8-35485 describe compressors that incorporate oil recovery devices. Each of these compressors has a housing, which houses a discharge chamber, a crank chamber, and cylinder bores. A rotatable drive shaft is supported in the housing such that it extends through the crank chamber. A swash plate is supported in the crank chamber and supported by the drive shaft such that it rotates integrally with the drive shaft. A piston is accommodated in each cylinder bore and coupled to the swash plate. When the drive shaft is rotated by an external drive source, such as an automotive engine, the swash plate converts the rotation of the drive shaft to linear reciprocation of each piston in the associated cylinder bore. The reciprocation of each piston draws refrigerant gas into the cylinder bore, compresses the gas, and discharges the gas into the discharge chamber.

A typical compressor has a muffler located downstream of the discharge chamber. The muffler has a gas outlet that is connected with an external refrigerant circuit. Accordingly, the refrigerant gas in the discharge chamber is sent to the external refrigerant circuit by way of the muffler. The muffler attenuates the pressure pulsation of the refrigerant gas. This reduces vibrations and noise, which result from pressure pulsation of the refrigerant gas.

Atomized lubricating oil is suspended in the refrigerant gas to lubricate moving parts in the compressor as the refrigerant gas flows through the compressor. However, the lubricating oil that travels through the compressor is sent to the external refrigerant circuit together with the refrigerant gas. If a large amount of lubricating oil is discharged from the compressor, the amount of lubricating oil in the compressor decreases. This may lead to insufficient lubrication. Accordingly, the mufflers of the compressors described in the above publications incorporate a device for separating and recovering the lubricating oil from the refrigerant gas. The oil recovery device includes an oil separating chamber, which is arranged in the muffler, and a cylindrical tube, which is secured to the gas outlet such that the tube projects into the oil separating compartment. Further, a recovery passage connects the oil separating chamber to the crank chamber.

As the refrigerant gas flows from the muffler toward the external refrigerant circuit, the refrigerant gas swirls about the tube in the oil separating chamber. The refrigerant gas then enters the tube and flows through the gas outlet into the external refrigerant circuit. Centrifugal force acts on the refrigerant gas swirling about the tube. The centrifugal force separates the lubricating oil from the refrigerant gas. The separated lubricating oil is then sent to the crank chamber through the recovery passage. This maintains satisfactory lubrication in the compressor.

The location of the gas outlet is normally changed in accordance with the type of vehicle in which the compressor is installed. The layout of various equipment in the engine compartment differs in each type of vehicle. Thus, the arrangement of the compressor and the external refrigerant circuit depends on the spatial limitations resulting from the layout of the engine compartment. There are cases in which the location of the gas outlet on the compressor must be changed because of the engine compartment layout. As a result, the structure of the oil recovery device must also be changed. Such changes decrease production efficiency and increases costs.

SUMMARY OF THE INVENTION

Accordingly, it is an objective of the present invention to provide a compressor having an oil recovery device that permits the location of the gas outlet to be easily changed without making changes to the oil recovery device.

To achieve the above objective, the present invention provides a compressor for compressing gas that contains atomized oil. The compressor includes a housing, a gas compression mechanism located within the housing, and a discharge chamber into which the gas compressed by the compression mechanism is discharged. A muffler base is arranged on the housing. A muffler cover is attached to the muffler base such that a muffler is enclosed by the muffler base and the muffler cover. A partition separates the muffler into a first muffler chamber and a second muffler chamber. The first muffler chamber is defined by the muffler base and the partition. The second muffler chamber is defined by the muffler cover and the partition. The partition has an opening for connecting the first muffler chamber with the second muffler chamber. The muffler cover has a gas outlet connected with the second muffler chamber. A discharge passage connects the discharge chamber to the first muffler chamber. Compressed gas is sent out of the compressor by way of the discharge chamber, the discharge passage, the first muffler chamber, the partition opening, the second muffler chamber, and the gas outlet. Pressure pulsation of the compressed gas is attenuated by the first and second muffler chambers. The atomized oil is separated from the compressed gas when passing through the first muffler chamber. A recovery passage is connected to the first muffler chamber to drain the separated oil in the first muffler chamber to portions of the compressor requiring lubrication.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
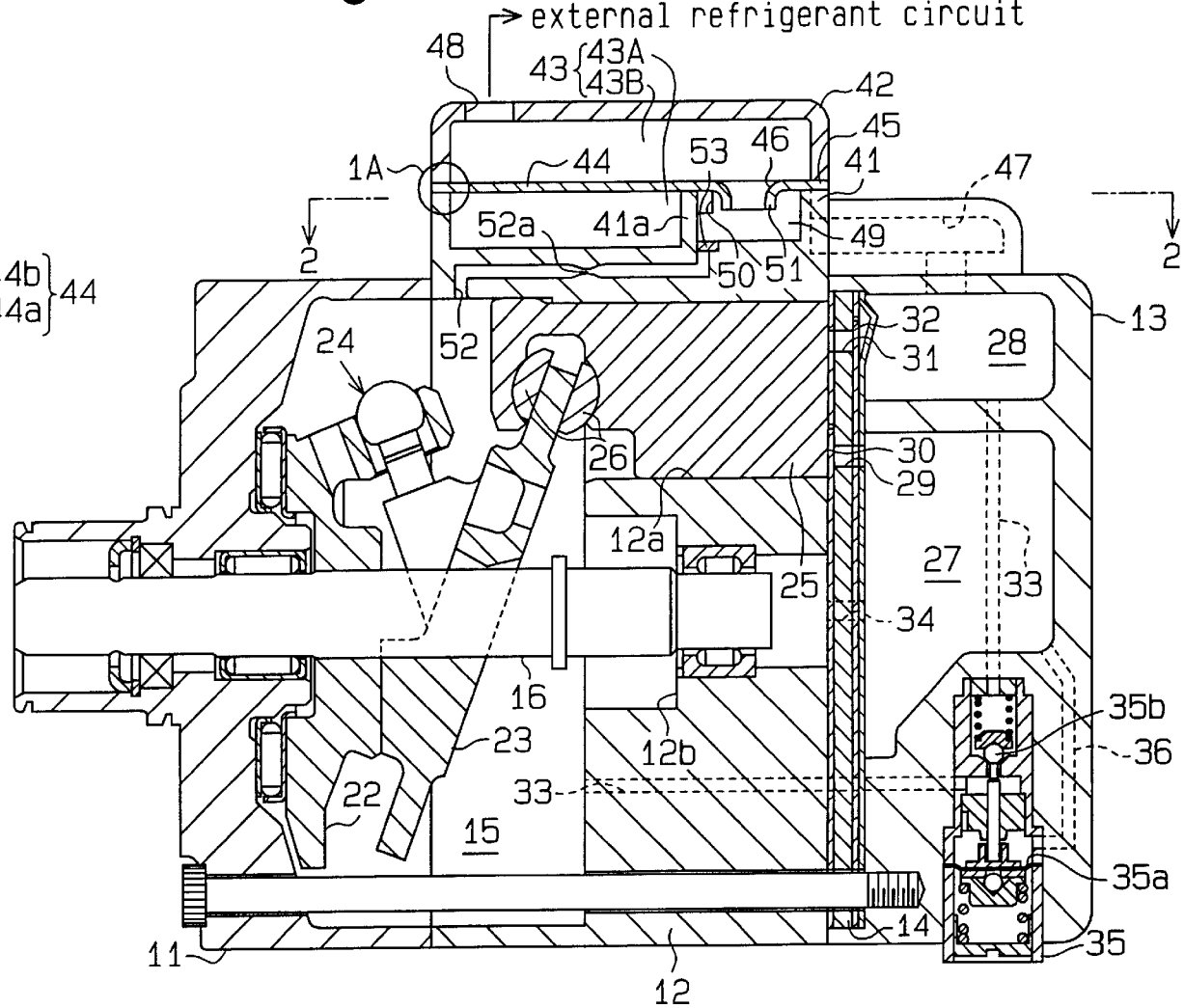
FIG. 1 is a cross-sectional view showing a first embodiment of a variable displacement compressor according to the present invention.

A first embodiment of a variable displacement compressor according to the present invention will now be described with reference to FIGS. 1 and 2. As shown in FIG. 1, the compressor has a front housing 11, which is coupled to the front end of a cylinder block 12. A rear housing 13 is coupled to the rear end of the cylinder block 12 with a valve plate 14 arranged in between. The front housing 11, the cylinder block 12, and the rear housing 13 define a compressor housing.

A crank chamber 15 is defined in the front housing 11 in front of the cylinder block 12. A drive shaft 16 extends through the crank chamber 15 and is rotatably supported by the front housing 11 and the cylinder block 12. The drive shaft 16 is connected to an external drive source, or an engine, by a clutch mechanism such as an electromagnetic clutch. During operation of the engine, the drive shaft 16 is rotated when the clutch connects the engine to the drive shaft 16.

A rotor 22 is fixed to the drive shaft 16 in the crank chamber 15. A drive plate, or swash plate 23, is supported inclinably on the drive shaft 16. A hinge mechanism 24 connects the swash plate 23 to the rotor 22. The hinge mechanism 24 rotates the swash plate 23 integrally with the drive shaft 16 while permitting inclination of the swash plate 23 with respect to the drive shaft 16.

Cylinder bores 12*a* (only one shown) extend through the cylinder block 12. A single-headed piston 25 is accommodated in each cylinder bore 12*a*. Each piston 25 is coupled to the peripheral portion of the swash plate 23 by a pair of shoes 26. The swash plate 23 and the shoes 26 convert the rotation of the drive shaft 16 to reciprocation of each piston 25 in the associated cylinder bore 12*a*.

A suction chamber 27 and a discharge chamber 28 are defined in the rear housing 13. A suction port 29 and a suction flap 30, which opens and closes the suction port 29 are formed in the valve plate 14 in association with each cylinder bore 12*a*. A discharge port 31 and a discharge flap 32, which opens and closes the discharge port 31, are also formed in the valve plate 14 in association with each cylinder bore 12*a*. When each piston 25 moves from its top dead center position to its bottom dead center position, the refrigerant gas in the suction chamber 27 opens the suction flap 30 and enters the associated cylinder bore 12*a* through the suction port 29. When the piston 25 moves from the bottom dead center position to the top dead center position, the refrigerant gas in the cylinder bore 12*a* is first compressed. The compressed gas then opens the discharge flap 32 and enters the discharge chamber 28 through the discharge port 31. The drive shaft 16, the swash plate 23, and the pistons 25 define a compression mechanism for compressing the refrigerant gas.

A pressurizing passage 33 extends through the rear housing 13, the valve plate 14, and the cylinder block 12 to connect the discharge chamber 28 to the crank chamber 15. A bleeding passage 34 extends through the center of the valve plate 14. The rear end of the drive shaft 16 is inserted into a shaft bore 12*b*, which extends through the center of the cylinder block 12, and is supported by a bearing. The refrigerant gas in the crank chamber 15 flows toward the suction chamber 27 by way of the shaft bore 12*b*, the space between the bearing and the drive shaft 16, and the bleeding passage 34.

A displacement control valve 35 is installed in the rear housing 13 and arranged in the pressurizing passage 33. A communication passage 36 extends through the rear housing 13 to communicate the pressure of the suction chamber 27 to the control valve 35. The control valve 35 includes a diaphragm 35*a*, which serves as a pressure sensing member, and a valve body 35*b*, which is operably connected to the diaphragm 35*a* by a rod.

The diaphragm 35*a* moves the valve body 35*b* in accordance with the pressure of the suction chamber 27 (suction pressure) communicated to the control valve 35 through the communication passage 36. The movement of the valve body 35*b* alters the opened amount of the pressurizing passage 33. The amount of refrigerant gas that flows into the crank chamber 15 from the discharge chamber 28 relies on the opened amount of the pressurizing passage 33 and determines the pressure of the crank chamber 15. Therefore, the control valve 35 changes the difference between the pressure of the crank chamber 15, which acts on one side of the pistons 25, and the pressure of the cylinder bores 12*a*, which acts on the other side of the pistons 25. Changes in the pressure difference alters the inclination of the swash plate 23. This, in turn, changes the stroke of the pistons 25 and varies the displacement of the compressor.

Figure 2:
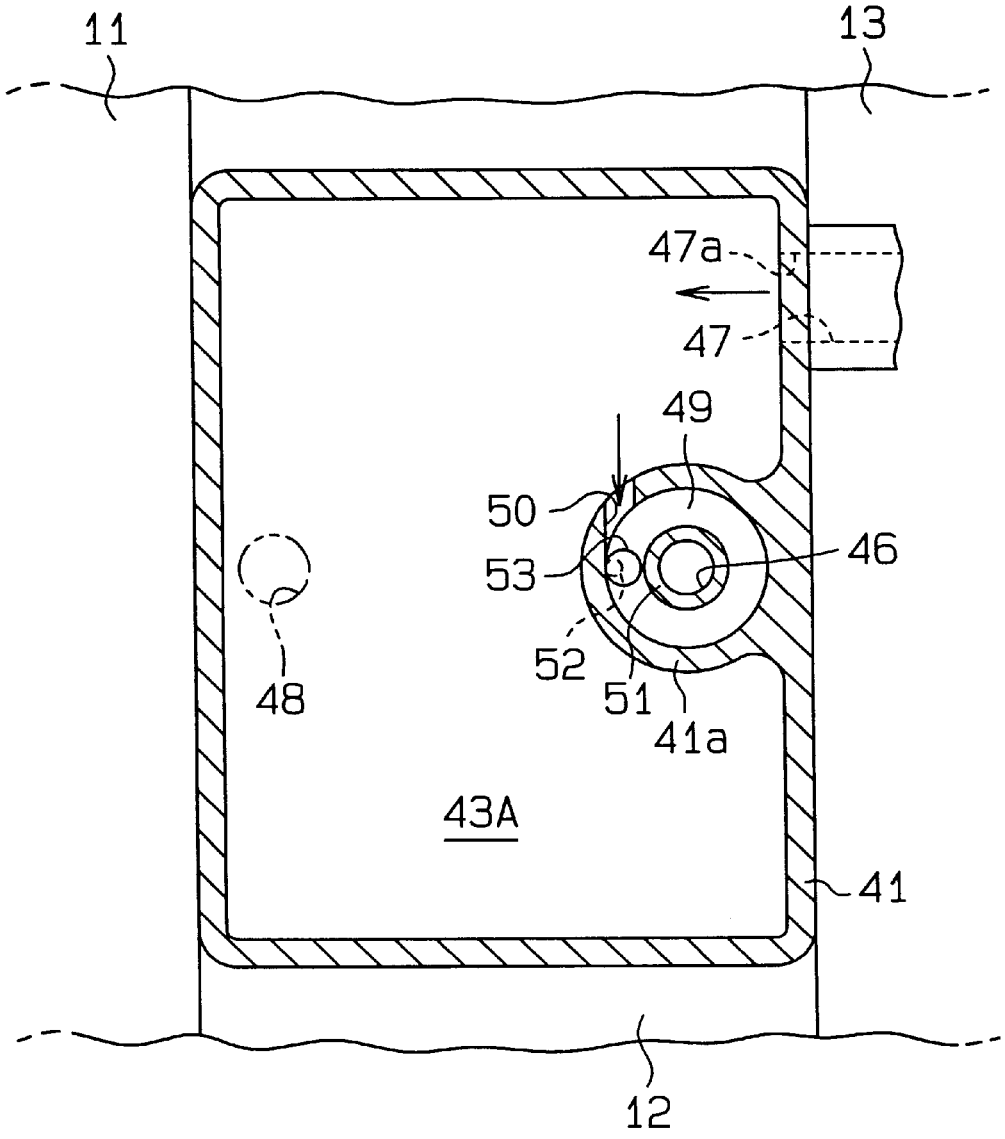
FIG. 2 is a cross-sectional view taken along line 2—2 in FIG. 1.

As shown in FIGS. 1 and 2, a muffler base 41 projects integrally from the outer surface of the cylinder block 12.

Figure 1A:
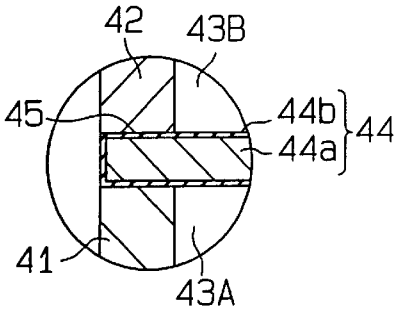
FIG. 1A is an enlarged view showing the encircled portion of FIG. 1.

A muffler cover 42 is fixed to the top of the muffler base 41. A muffler 43 is housed by the muffler base 41 and the muffler cover 42. A gasket 44, which serves as a partition, is arranged between the muffler base 41 and the muffler cover 42 to define a first muffler chamber 43A, which is encompassed by the muffler base 41, and a second muffler chamber 43B, which is encompassed by the muffler cover 42. As shown in FIG. 1A, the gasket 44 includes a flat metal base plate 44*a* and a synthetic resin rubber coating 44*b*, which is applied to the surface of the base plate 44*a*. The gasket 44 has a rim 45, which seals the space between the muffler base 41 and the muffler cover 42. The coating 44*b* has superior adhesion properties and securely seals the space between the muffler base 41 and the muffler cover 42.

A discharge passage 47 connects the discharge chamber 28 to the first muffler chamber 43A. The discharge passage 47 has an outlet 47*a*, which extends through the wall of the muffler base 41 to connect the discharge passage 47 with the first muffler chamber 43A. An opening 46 extends through the gasket 44 to connect the first muffler chamber 43A with the second muffler chamber 43B. The opening 46 does not face and is misaligned with the discharge passage outlet 47*a*. A cylindrical separating tube 51 is formed integrally with the gasket 44 about the opening 46 projecting into the first muffler chamber 43A. A gas outlet 48 extends through the top surface of the muffler cover 42. The gas outlet 48 connects the second muffler chamber 43B to an external refrigerant circuit.

A cylindrical wall 41*a*, which encompasses the separating tube 51, projects from the bottom surface of the first muffler chamber 43A. The top of the cylindrical wall 41*a* contacts the gasket 44. The space between the inner side of the cylindrical wall 41*a* and the gasket 44 defines a swirling chamber 49 in the first muffler chamber 43A. The separating tube 51 is arranged in the swirling chamber 49 such that its axis coincides with the axis of the swirling chamber 49. An intake passage 50 extends through the cylindrical wall 41*a* to connect the first muffler chamber 43A with the swirling chamber 49. The intake passage 50 does not face and is misaligned with the discharge passage outlet 47*a*. The axis of the inlet passage 50 is tangential to the inner surface of the wall 41*a*, as shown in FIG. 2.

A recovery passage 52 extends through the cylinder block 12 to connect the first muffler chamber 43A, and particularly the swirling chamber 49, to the crank chamber 15. The recovery passage 52 has an inlet, which is located in the bottom surface of the swirling chamber 49. The inlet of the recovery passage 52 is misaligned with both the discharge passage outlet 47*a* and the intake passage 50. A filter 53 is arranged in the inlet. A throttle 52*a* is provided in the recovery passage 52.

The refrigerant gas discharged into the discharge chamber 28 is sent to the external refrigerant circuit by way of the discharge passage 47, the first muffler chamber 43A, the intake passage 50, the swirling chamber 49, the opening 46, the second muffler chamber 43B, and the gas outlet 48. The first and second muffler chambers 43A, 43B attenuate the pressure pulsation of the refrigerant gas. This reduces vibrations and noise, which result from pressure pulsation of the refrigerant gas.

Atomized lubricating oil is suspended in the refrigerant gas. The refrigerant gas thus lubricates the parts that move and contact other parts in the compressor, such as the swash plate 23 and the shoes 26. The lubricating oil travels through the discharge chamber 28 and the discharge passage 47 and enters the first muffler chamber 43A together with the refrigerant gas. When the stream of refrigerant gas collides against the inner surface of the muffler chamber 43A and changes directions, some of the lubricating oil suspended in the refrigerant gas is separated from the gas and collected on the inner surface of the first muffler chamber 43A. The separated lubricating oil then enters the swirling chamber 49 through the intake passage 50 together with the refrigerant gas.

The intake passage 50 is tangential to the inner surface of the swirling chamber 49. Thus, the refrigerant gas that enters the swirling chamber 49 through the intake passage 50 swirls about the separating tube 51. Centrifugal force acts on the refrigerant gas swirling about the separating tube 51 and effectively separates lubricating oil from the refrigerant gas. The refrigerant gas then flows into the second muffler chamber 43B through the opening 46 and enters the external refrigerant circuit through the gas outlet 48.

The lubricating oil separated from the refrigerant gas is collected in the swirling chamber 49. The pressure in the swirling chamber 49 is higher than that in the crank chamber 15. Therefore, the lubricating oil in the swirling chamber 49 is sent to the crank chamber 15 through the recovery passage 52. Accordingly, satisfactory lubrication continues in the compressor.

The control valve 35 adjusts the amount of refrigerant gas that flows into the crank chamber 15 from the discharge chamber 28. However, if a large amount of refrigerant gas flows from the swirling chamber 49 into the crank chamber 15 though the recovery passage 52, this would interfere with the functions of the control valve 35. In such case, the control valve 35 would not be able to properly control the compressor displacement. However, the throttle 52*a* in the recovery passage 52 limits the amount of refrigerant gas flowing into the crank chamber 15 from the swirling chamber 49. Thus, the pressure in the crank chamber 15 is not significantly affected by the refrigerant gas from the swirling chamber 49. Accordingly, the compressor displacement is not influenced by the refrigerant gas from the swirling chamber 49.

Foreign matter in the lubricating oil may clog the recovery passage 52, especially at the throttle 52*a*. However, the filter 53, which is arranged at the inlet of the recovery passage 52 prevents foreign matter from entering the recovery passage 52. Thus, the recovery passage 52 is kept open.

The gasket 44 divides the muffler 43 into two parts, the first muffler chamber 43A and the second muffler chamber 43B. The swirling chamber 49 and the separating tube 51, which serve to separate lubricating oil from the refrigerant gas and recover the oil, are arranged in the first muffler chamber 43A in association with the opening 46 of the gasket 44. The recovery passage 52 connects the swirling chamber 49 to the crank chamber 15. The gas outlet 48, which is provided in the muffler cover 42, is connected with the second muffler chamber 43B.

Accordingly, the location of the gas outlet 48 does not affect the arrangement of the swirling chamber 49, the separating tube 51, and the recovery passage 52. Thus, the compressor of the preferred embodiment may be applied to different types of vehicles merely by preparing muffler covers 42 having gas outlets 48 located at different positions. Other changes are not necessary. Since the structural changes to the compressor are minimal when adapting to different types of vehicles, the production of the compressor is simplified and productions costs are reduced.

The flow path of the refrigerant gas is complicated due to the two muffler chambers 43A, 43B, which are separated from each other. The intake passage 50, the swirling chamber 49, and the separating tube 51 further complicate the flow path of the refrigerant gas. This effectively attenuates the pressure pulsation of the refrigerant gas.

The gasket 44 not only seals the space between the muffler base 41 and the muffler cover 42 but also serves to partition the muffler 43 into two chambers. In addition, the separating tube 51 is formed integrally with the gasket 44. This reduces the number of parts and provides a simplified structure in comparison to a compressor employing a gasket, a partition, and a separating tube that are formed independently from one another.

The intake passage 50 does not face and is misaligned with the outlet 47*a* of the discharge passage 47 in the first muffler chamber 43A. Thus, the refrigerant gas that flows into the first muffler chamber 43A through the discharge passage outlet 47*a* generally flows through the entire first muffler chamber 43A before entering the swirling chamber 49 through the intake passage 50. Accordingly, the lubricating oil separated from the refrigerant gas in the first muffler chamber 43A is forced into the swirling chamber 49 by the stream of the refrigerant gas in the muffler chamber 43A. In other words, all of the lubricating oil in the first muffler chamber 43A is sent toward the swirling chamber 49. This increases the recovery rate of the lubricating oil.

Figure 3:
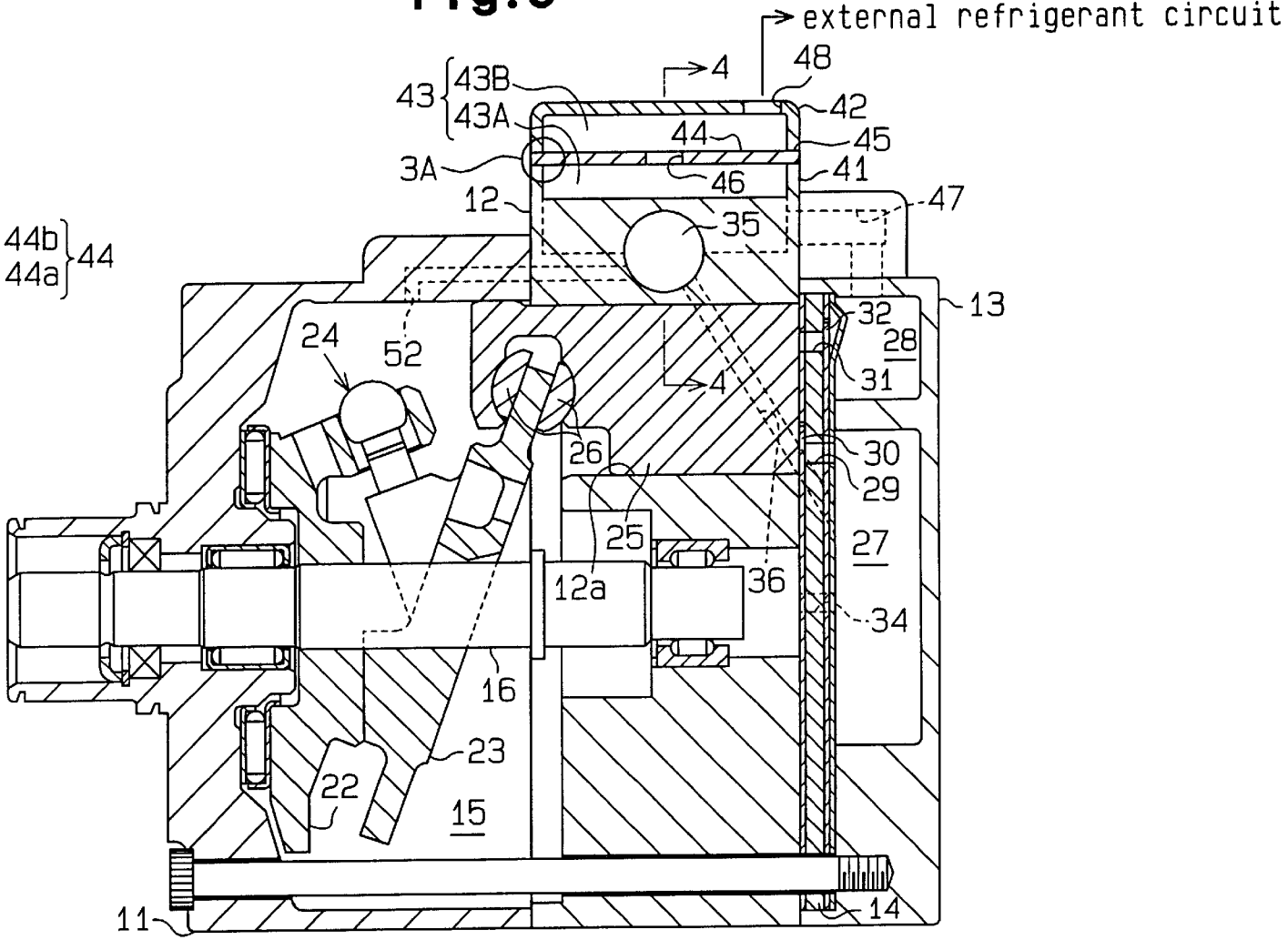
FIG. 3 is a cross-sectional view showing a second embodiment of a variable displacement compressor according to the present invention.

A second embodiment according to the present invention will now be described with reference to FIGS. 3 and 4. The description will center on parts differing the first embodiment. The swirling chamber 49 and the separating tube 51 of the first embodiment are not employed in this embodiment. Furthermore, the displacement control valve 35 is installed in the muffler base 41 and arranged midway in the recovery passage 52. The recovery passage 52 functions not only to send lubricating oil to the crank chamber 15 but also as a pressurizing passage (corresponding to the pressurizing passage 33 employed in the embodiment of FIG. 1). The recovery passage 52 does not have a throttle.

Figure 4:
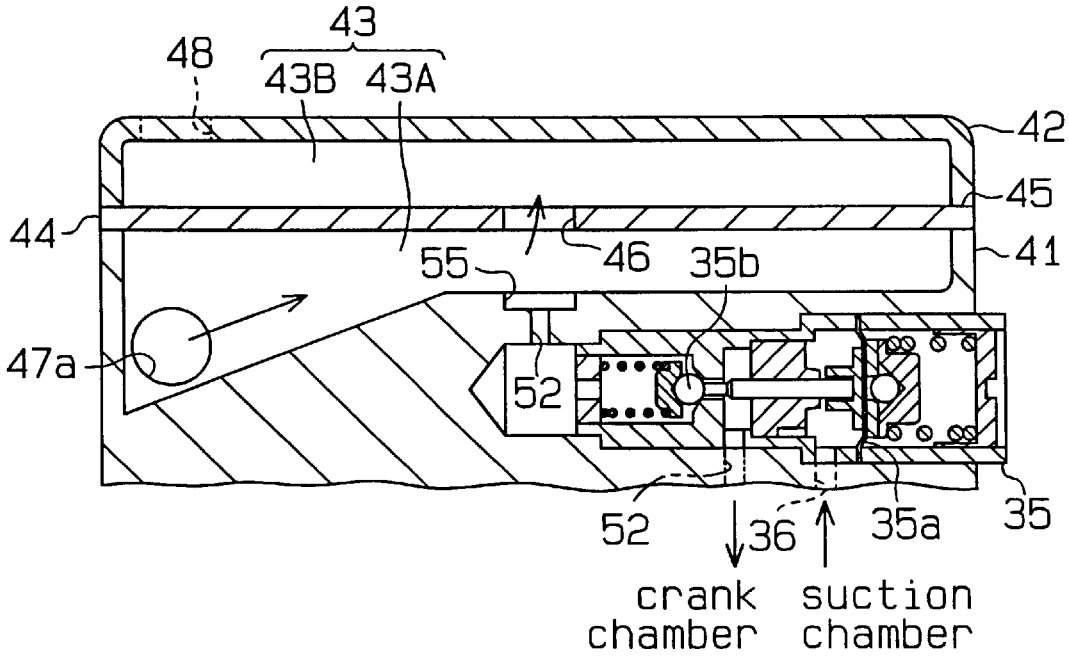
FIG. 4 is a cross-sectional view taken along line 4—4 in FIG. 3.

The recovery passage 52 has an inlet located in the bottom surface of the first muffler chamber 43A directly below the opening 46 of the gasket 44 (FIG. 4). An oil sink 55 is formed in the bottom surface of the first muffler chamber 43A in association with the inlet of the recovery passage 52.

Figure 3A:
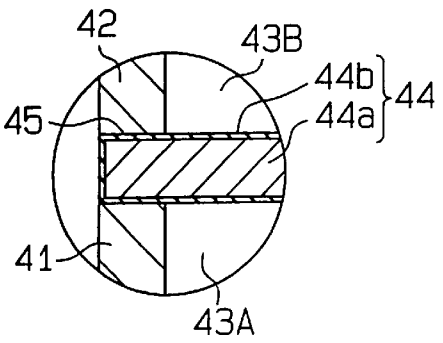
FIG. 3A is an enlarged view showing the encircled portion of FIG. 3.

As shown in FIG. 3A, the structure of the gasket 44 is similar to that of the gasket 44 employed in the embodiment illustrated in FIG. 1A.

Refrigerant gas flows into the first muffler chamber 43A through the outlet 47*a* of the discharge passage 47. When the stream of refrigerant gas contacts the inner surface of the muffler chamber 43A and changes directions, some of the lubricating oil suspended in the refrigerant gas is separated from the gas and collected on the inner surface of the first muffler chamber 43A. The separated lubricating oil is moved toward the opening 46 by the stream of refrigerant gas and collected in the oil sink 55. When the control valve 35 opens the recovery passage 52, the lubricating oil in the oil sink 55 is sent to the crank chamber 15 through the recovery passage 52 together with the refrigerant gas in the first muffler chamber 43A. Accordingly, the second embodiment has the same advantages as the first embodiment.

The amount of lubricating oil supplied to the crank chamber 15 is varied in accordance with the opened amount of the recovery passage 52, which is controlled by the control valve 35. For example, if the displacement of the compressor is small, the amount of lubricating gas that flows into the compressor is small. This may lead to insufficient lubrication in the compressor. However, the control valve 35 increases the opened amount of the recovery passage 52 when decreasing the displacement of the compressor. In other words, the amount of lubricating oil supplied to the crank chamber 15 increases when the displacement of the compressor is small. This prevents insufficient lubrication.

In the second embodiment, the recovery passage 52 also serves as a pressurizing passage. Therefore, separate passages for each purpose need not be provided. This simplifies production of the compressor. Furthermore, the recovery passage 52 does not include a throttle. Thus, the diameter of the recovery passage 52 can be enlarged. This prevents foreign matter from clogging the recovery passage 52. Accordingly, a filter for removing foreign matter need not be provided. This decreases the number of components. If necessary, however, a filter may be located in the oil sink 55.

The opening 46 does not face and is misaligned with the outlet 47*a* of the discharge passage 47. Also, the inlet of the recovery passage 52 is misaligned with the discharge passage outlet 47*a* as seen in FIG. 4. Thus, the refrigerant gas that flows into the first muffler chamber 43A though the discharge passage outlet 47*a* generally flows through the entire first muffler chamber 43A before entering the second muffler chamber 43B through the opening 46. Accordingly, the lubricating oil separated from the refrigerant gas in the first muffler chamber 43A is forced toward the opening 46 by the stream of the refrigerant gas in the muffler chamber 43A. In other words, all of the lubricating oil in the first muffler chamber 43A is collected in the oil sink 55, which is located directly below the opening 46. This increases the recovery rate of the lubricating oil.

The control valve 35 extends perpendicular to the axis of the drive shaft 16 in the muffler base 41. This allows the dimensions of the compressor to be decreased in the axial direction.

It should be apparent to those skilled in the art that the present invention may be embodied in many other specific forms without departing from the spirit or scope of the invention. More specifically, the present invention may be embodied as described below.

Figure 5:
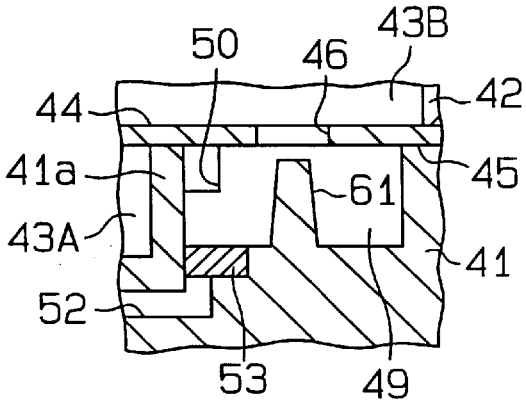
FIG. 5 is a partial cross-sectional view showing an oil recovery device employed in a further embodiment according to the present invention.

As shown in FIG. 5, the separating tube 51 of the first embodiment may be replaced by a cylindrical separating pillar 61, which projects from the bottom surface of the swirling chamber 49. The separating pillar 61 is located directly below the connecting bore 46 such that the separating pillar 61 and the connecting bore 46 are coaxial. The refrigerant gas drawn into the swirling chamber 49 is swirled about the separating pillar 61 before flowing through the connecting bore 46 and into the second muffler chamber 43B.

In the first embodiment, the outlet of the recovery passage 52 may be connected with the suction chamber 27 instead of the crank chamber 15. The difference between the pressure of the swirling chamber 49 and the pressure of the suction chamber 27 is greater than the difference between the pressure of the swirling chamber 49 and the pressure of the crank chamber 15. Accordingly, the lubricating oil collected in the swirling chamber 49 would be readily drawn into the suction chamber 27 through the recovery passage 52.

In the first embodiment, the separating tube 51 and the gasket 44 may be formed separately. The separating pillar 61 of the embodiment illustrated in FIG. 5 may be formed separately from the bottom surface of the swirling chamber 49.

In the first embodiment, the displacement control valve 35 may be arranged in a bleeding passage that connects the crank chamber 15 to the suction chamber 27. In this case, the control valve 35 adjusts the amount of refrigerant gas released into the suction chamber 27 from the crank chamber 15 to control the pressure of the crank chamber 15.

In the above embodiments, the muffler base 41 may be formed integrally with the cylinder block 12 such that the opening of the muffler base 41 faces toward the front or toward the rear. In this case, a muffler cover 42 is formed integrally with either the front housing 11 or the rear housing 13 depending on which way the opening of the muffler base 41 faces. By coupling the cylinder block 12 to the front housing 11 or the rear housing 13, a muffler 43 is formed between the muffler base 41 and the muffler cover 42. On the other hand, the muffler base 41 may be formed on the front housing 11 or the rear housing 13 and the muffler cover 42 may be formed on the cylinder block 12. Although not shown in FIG. 1, a gasket is arranged between the cylinder block 12 and each housing 11, 13 to seal the space in between. Accordingly, the gasket may also serve to partition the muffler 43 into two chambers.

The present invention is not limited to variable displacement compressors such as that shown in FIG. 1 and may be applied to a fixed displacement type compressor. Additionally, the present invention is not limited to swash plate type compressors. For example, the present invention may be applied to vane type compressors, scroll type compressors, and wave cam type compressors.

Therefore, the present examples and embodiments are to be considered as illustrative and not restrictive, and the invention is not to be limited to the details given herein, but may be modified within the scope and equivalence of the appended claims.

What is claimed is:

1. A compressor for compressing gas that contains atomized oil, the compressor including a housing, a gas compression mechanism located within the housing, and a discharge chamber into which the gas compressed by the compression mechanism is discharged, wherein the compressor comprises:

a muffler base arranged on the housing;

a muffler cover removably attached to the muffler base such that a muffler is enclosed by the muffler base and the muffler cover;

a partition separating the muffler into a first muffler chamber and a second muffler chamber, the first muffler chamber being defined by the muffler base and the partition and the second muffler chamber being defined by the muffler cover and the partition, wherein the partition has an opening for connecting the first muffler chamber with the second muffler chamber, and wherein the muffler cover has a gas outlet connected with the second muffler chamber;

a discharge passage connecting the discharge chamber to the first muffler chamber, wherein compressed gas is sent out of the compressor by way of the discharge chamber, the discharge passage, the first muffler chamber, the partition opening, the second muffler chamber, and the gas outlet, wherein pressure pulsation of the compressed gas is attenuated by the first and second muffler chambers, and wherein the atomized oil is separated from the compressed gas when passing through the first muffler chamber and the gas outlet is located at any one of a plurality of locations on the muffler cover without affecting the oil separating operation of the first muffler chamber; and a recovery passage connected to the first muffler chamber to drain the separated oil in the first muffler chamber to portions of the compressor requiring lubrication.

2. The compressor according to claim 1, wherein the recovery passage has an inlet located in the vicinity of the partition opening.

3. The compressor according to claim 2, wherein a filter is arranged in the inlet of the recovery passage.

4. The compressor according to claim 1, wherein the discharge passage has an outlet connected with the first muffler chamber, and wherein the outlet of the discharge passage is misaligned with the partition opening.

5. The compressor according to claim 1, wherein the first muffler chamber includes a gas swirling chamber, wherein the partition opening is connected with the swirling chamber and the recovery passage has an inlet connected with the swirling chamber, and wherein the compressed gas is swirled when drawn into the swirling chamber from the first muffler chamber so that centrifugal force acts on the swirling compressed gas and separates the oil from the compressed gas.

6. The compressor according to claim 5, wherein the partition includes a tube projecting into the swirling chamber about the partition opening, the compressed gas being swirled about the tube in the swirling chamber.

7. The compressor according to claim 5, wherein the swirling chamber accommodates a cylindrical pillar that is coaxial to the partition opening, the compressed gas being swirled about the cylindrical pillar in the swirling chamber.

8. The compressor according to claim 1, wherein the partition includes a gasket for sealing the space between the muffler base and the muffler cover.

9. The compressor according to claim 1, wherein the housing surrounds a crank chamber, which contains part of the compression mechanism, and wherein the recovery passage connects the first muffler chamber to the crank chamber.

10. The compressor according to claim 9, wherein the recovery passage includes a throttle.

11. The compressor according to claim 1, wherein the housing houses a crank chamber and a cylinder bore, and wherein the compression mechanism includes a drive shaft supported rotatably in the housing, a drive plate supported on the drive shaft and arranged in the crank chamber, and a piston operably connected to the drive plate and retained in the cylinder bore.

12. The compressor according to claim 11, wherein the drive plate is a swash plate that is supported on the drive shaft, the swash plate being inclined with respect to the drive shaft to change the stroke of the piston and control the displacement of the compressor, the inclination of the swash plate being determined by the difference between the pressure of the crank chamber and the pressure of the cylinder bore, and wherein the compressor further comprises a control valve for controlling the pressure of the crank chamber.

13. The compressor according to claim 12 further comprising a pressurizing passage for connecting the discharge chamber to the crank chamber, the control valve being arranged in the pressurizing passage to adjust the amount of gas flowing into the crank chamber from the discharge chamber.

14. The compressor according to claim 13, wherein the recovery passage is joined with the pressurizing passage.

15. The compressor according to claim 14, wherein the control valve is located in the muffler base.

16. A compressor for compressing gas that contains atomized oil, the compressor including a housing, a gas compression mechanism arranged in the housing to compress the gas, and a discharge chamber into which the gas compressed by the compression mechanism is discharged, wherein the compressor comprises:

a muffler base arranged on the housing;

a muffler cover removably attached to the muffler base such that a muffler is enclosed by the muffler base and the muffler cover;

a partition separating the muffler into the first muffler chamber and a second muffler chamber, the first muffler chamber being defined by the muffler base and the partition and the second muffler chamber being defined by the muffler cover and the partition, and wherein the muffler cover has a gas outlet connected with the second muffler chamber to send the compressed gas out of the compressor;

a discharge passage connecting the discharge chamber to the first muffler chamber;

a cylindrical wall defining a gas swirling chamber in the first muffler chamber, the cylindrical wall having an intake passage connecting the swirling chamber to the first muffler chamber, the partition having an opening connecting the swirling chamber to the second muffler chamber, wherein pressure pulsation of the compressed gas is attenuated by the first and second muffler chambers, wherein the compressed gas is swirled when drawn into the swirling chamber from the first muffler chamber, and wherein the oil is separated from the compressed gas by centrifugal force acting on the swirling compressed gas and the gas outlet is located at any one of a plurality of locations on the muffler cover independent of the location of the swirling chamber; and a recovery passage connected to the swirling chamber to drain the separated oil in the swirling chamber to parts requiring lubrication in the compressor.

17. The compressor according to claim 16, wherein the housing surrounds a crank chamber, which contains part of the compression mechanism, and wherein the recovery passage connects the swirling chamber to the crank chamber.

18. The compressor according to claim 16, wherein the discharge passage has an outlet connected with the first muffler chamber, wherein the outlet of the discharge passage is misaligned with the intake passage.

19. The compressor according to claim 16, wherein the partition includes a tube projecting into the swirling chamber about the partition opening, the compressed gas being swirled about the tube in the swirling chamber.

20. The compressor according to claim 19, wherein the partition includes a gasket for sealing the space between the muffler base and the muffler cover.

21. A compressor for a vehicle air conditioning system, wherein the compressor comprises:

a housing;

a gas compression mechanism located within the housing;

a discharge chamber into which gas compressed by the compression mechanism is discharged;

a muffler base located on the housing;

a muffler cover attached to the muffler base; a muffler housed by the muffler base and the muffler cover;

a partition dividing the muffler into a first muffler chamber and a second muffler chamber, wherein the muffler base and the partition define the first muffler chamber, and the muffler cover and the partition define the second muffler chamber, and an opening is formed in the partition to connect the first and second muffler chambers;

a discharge passage connecting the discharge chamber to the first muffler chamber, wherein the compressed gas travels by way of the discharge chamber, the discharge passage, the first muffler chamber, the partition opening, and the second muffler chamber, wherein pressure pulsation of the compressed gas is attenuated by the first and second muffler chambers, and wherein the first muffler chamber removes atomized oil from the compressed gas; and a gas outlet is formed in the muffler cover for permitting the compressed gas to exit the second muffler chamber to an external refrigeration circuit, wherein the gas outlet is located at any one of a plurality of locations on the muffler cover without affecting the oil separating operation of the first muffler chamber, and the muffler cover is readily removable from the muffler base, such that the compressor can be adapted to different vehicles by choosing a muffler cover that has the gas outlet in an appropriate location for the vehicle in which the compressor is to be installed.

* * * * *

UNITED STATES PATENT AND TRADEMARK OFFICE

CERTIFICATE OF CORRECTION

PATENT NO. : 6,174,140 B1
DATED : January 16, 2001
INVENTOR(S) : Masaki Ota et al.

It is certified that error appears in the above-identified patent and that said Letters Patent is hereby corrected as shown below:

Column 3,
Lines 38-39, please change "suction port 29 are formed" to -- suction port 29, are formed --;

Column 4,
Lines 24-25, there should not be a new paragraph, please change
"the cylinder block 12.
A muffler cover 42" to -- the cylinder block 12. A muffler cover 42 --;
Lines 31-32, there should be a new paragraph, please change, "muffler cover 42. As shown in" to -- muffler cover 42.
As shown in --;

Column 5,
Line 54, please change, "15 though the recovery passage" to -- 15 through the recovery passage --;

Column 11,
Lines 16-17, there should be a new line, please change,
"the muffler base; a muffler housed" to -- the muffler base;
a muffler housed --.

Signed and Sealed this

Thirtieth Day of April, 2002

*Attest:*

*Attesting Officer*

JAMES E. ROGAN
*Director of the United States Patent and Trademark Office*